US010938169B2

(12) United States Patent
De Cloet et al.

(10) Patent No.: US 10,938,169 B2
(45) Date of Patent: Mar. 2, 2021

(54) METHOD FOR PRODUCING A MODULARLY CONFIGURABLE COAXIAL PLUG

(71) Applicant: TE Connectivity Germany GmbH, Bensheim (DE)

(72) Inventors: Olivier De Cloet, Lorsch (DE); Samir Aboulkassem, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/257,525

(22) Filed: Jan. 25, 2019

(65) Prior Publication Data

US 2019/0237919 A1 Aug. 1, 2019

(30) Foreign Application Priority Data

Jan. 26, 2018 (DE) ..... 102018101764.2

(51) Int. Cl.
*H01R 24/52* (2011.01)
*H01R 24/54* (2011.01)
(Continued)

(52) U.S. Cl.
CPC ..... *H01R 24/52* (2013.01); *H01R 9/05* (2013.01); *H01R 13/627* (2013.01);
(Continued)

(58) Field of Classification Search
CPC ..... H01R 9/05; H01R 13/627; H01R 13/639; H01R 24/52; H01R 24/54; H01R 24/542; H01R 43/16; H01R 43/20; H01R 2103/00
See application file for complete search history.

(56) References Cited

U.S. PATENT DOCUMENTS 4,209,742 A * 6/1980 Bender ..... G01R 1/06788 324/72.5
5,122,063 A * 6/1992 Cooper ..... H01R 13/646 403/96

(Continued)

FOREIGN PATENT DOCUMENTS

DE 102009043516 A1 4/2011
WO 2012116179 A2 8/2012

OTHER PUBLICATIONS

German Office Action, App. No. 10 2018 101 764.2 dated Oct. 30, 2018, 6 pages.

(Continued)

*Primary Examiner* — Oscar C Jimenez
(74) *Attorney, Agent, or Firm* — Barley Snyder

(57) ABSTRACT

A method for producing a modularly configurable plug comprises inserting a cable insulator in a pre-shaped outer cable contact, positioning an inner cable contact of a cable in the cable insulator, and bending the pre-shaped outer cable contact to form a cable section. The cable section is adapted to a diameter of the cable and a diameter of the inner cable contact. The method further comprises positioning an inner interface contact in an interface insulator and inserting the interface insulator in an outer interface contact to form an interface section. The interface section is connected to the cable section. The interface section has one of a plurality of different lengths or one of a plurality of different shapes interchangeably connected to the cable section.

19 Claims, 3 Drawing Sheets

(51) Int. Cl.

| | |
|---|---|
| ***H01R 43/20*** | (2006.01) |
| ***H01R 9/05*** | (2006.01) |
| ***H01R 13/627*** | (2006.01) |
| ***H01R 13/639*** | (2006.01) |
| ***H01R 43/16*** | (2006.01) |
| ***H01R 103/00*** | (2006.01) |

(52) U.S. Cl.

CPC ..... *H01R 13/639* (2013.01); *H01R 24/542* (2013.01); *H01R 43/16* (2013.01); *H01R 43/20* (2013.01); *H01R 2103/00* (2013.01)

(56) References Cited

U.S. PATENT DOCUMENTS 6,406,313 B1 * 6/2002 Victor ..... H01R 27/00 439/175
6,644,993 B2 * 11/2003 Victor ..... H01R 27/00 439/175
6,860,761 B2 3/2005 Lee et al.
6,916,201 B1 * 7/2005 Chu ..... H01R 9/05 439/578
7,207,844 B2 * 4/2007 Peng ..... H01R 13/64 439/173
7,241,169 B1 * 7/2007 Yang ..... H01R 31/06 439/172
8,858,258 B2 10/2014 Stokowski et al.
2012/0135625 A1 5/2012 Yokoyama et al.
2013/0157505 A1 * 6/2013 Sykes ..... H01R 9/05 439/578
2013/0203288 A1 8/2013 Hosler, Sr.
2013/0210292 A1 * 8/2013 Schmidt ..... H01R 4/06 439/775
2017/0310062 A1 * 10/2017 Eriksen ..... H01R 24/542

OTHER PUBLICATIONS

Extended European Search Report, European Patent Application No. 19154019.4, dated May 31, 2019, 12 pages.

* cited by examiner 4, 30
28
24
34

28
22
32

28
26

22
24
38

28
24
22
26
36

30
28
14

28
12

20
28
12
14

23
10
8

20
16
16
14
8
6

4
26
24
22

2
14
8
4

METHOD FOR PRODUCING A MODULARLY CONFIGURABLE COAXIAL PLUG

CROSS-REFERENCE TO RELATED APPLICATION

This application claims the benefit of the filing date under 35 U.S.C. § 119(a)-(d) of German Patent Application No. 102018101764.2, filed on Jan. 26, 2018.

FIELD OF THE INVENTION

The present invention relates to a method for producing a plug and, more particularly, to a method for producing a modularly configurable plug.

BACKGROUND

Plugs are conventionally used for producing a releasable electrically conductive plug connection with a socket or a coupling. Depending on the environmental conditions and requirements relating to electromagnetic compatibility, plugs with an outer contact can be used. The outer contact forms an electrically conductive outer sheath shielding from external electromagnetic fields.

Depending on installation positions of the corresponding sockets, it may be necessary to use a plug forming a 90° angle. It is thereby possible, for example, to reduce a mechanical loading of the cables and the socket. Plugs forming a 90° angle can be connected or crimped to cables manually or by semi-automatic devices developed specially for this purpose as so-called "loose-piece" components. Conventional devices or applicators for automatically joining the plug to a cable cannot process the 90° plugs due to the difference in dimensions.

The 90° plugs are often single-piece integrally constructed components and changes to the plug lead to exchange of the entire plug. Further, such 90° plugs can only be packed in a laborious manner on coils or rolls and arranged for processing on a carrier strip. There is therefore a need for a method for producing plugs in which the respective components of the plug can be selected in a variable manner and can be automatically processed with conventional applicators.

SUMMARY

A method for producing a modularly configurable plug comprises inserting a cable insulator in a pre-shaped outer cable contact, positioning an inner cable contact of a cable in the cable insulator, and bending the pre-shaped outer cable contact to form a cable section. The cable section is adapted to a diameter of the cable and a diameter of the inner cable contact. The method further comprises positioning an inner interface contact in an interface insulator and inserting the interface insulator in an outer interface contact to form an interface section. The interface section is connected to the cable section. The interface section has one of a plurality of different lengths or one of a plurality of different shapes interchangeably connected to the cable section.

BRIEF DESCRIPTION OF THE DRAWINGS

The invention will now be described by way of example with reference to the accompanying Figures, of which.

DETAILED DESCRIPTION OF THE EMBODIMENT(S)

Figure 2:
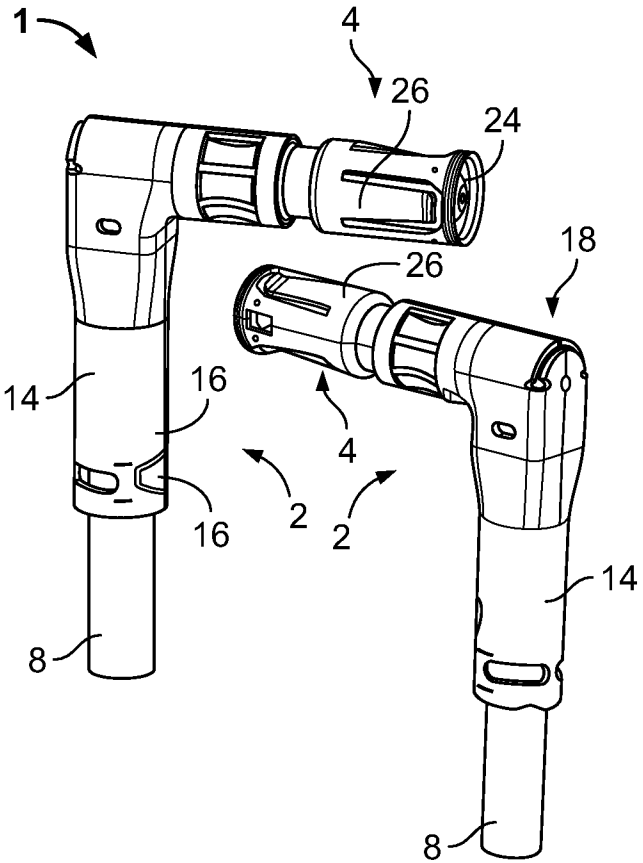
FIG. 2 is a perspective view of the coaxial plug.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

Figure 1:
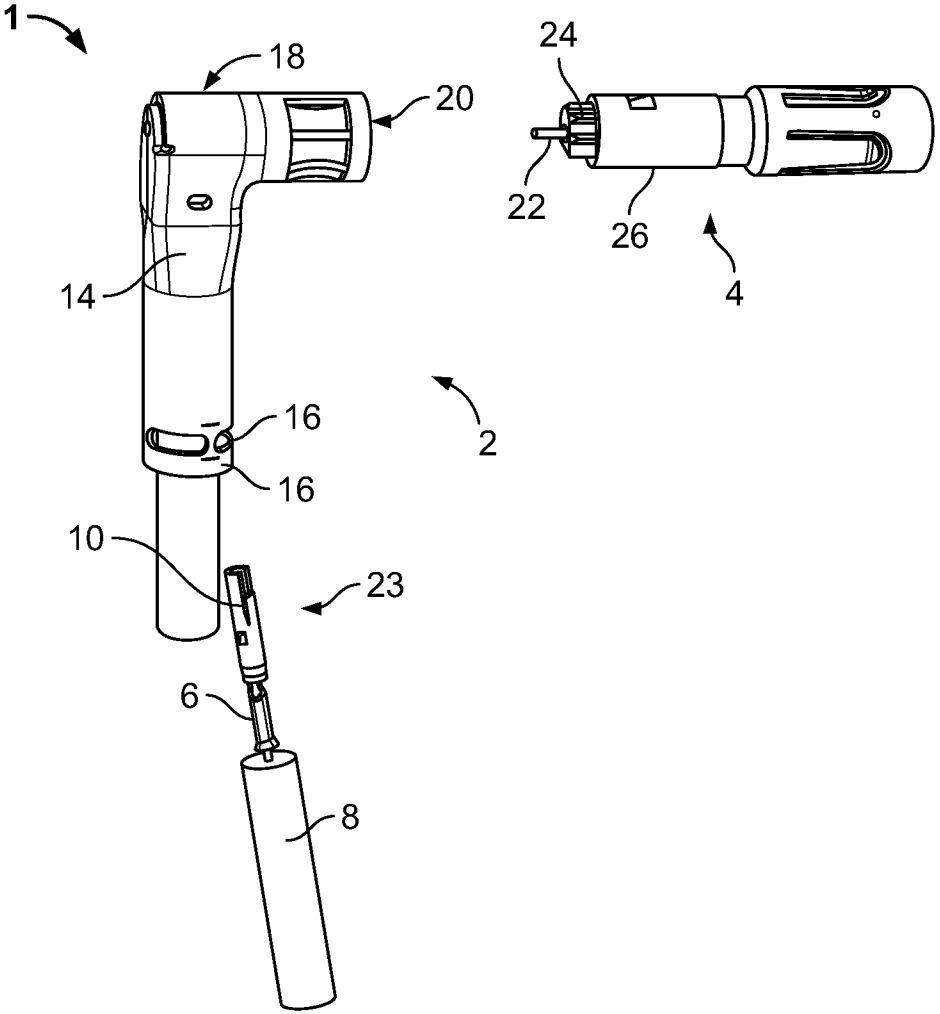
FIG. 1 is an exploded perspective view of a coaxial plug according to an embodiment.

A coaxial plug 1 according to an embodiment is shown in FIGS. 1 and 2 and includes a cable section 2 and an interface section 4.

The cable section 2, as shown in FIG. 1, receives a strand 6 of a cable 8 in an electrically conductive manner. In an embodiment, the strand 6 has already been crimped to an inner cable contact 10 of the cable section 2. The inner cable contact 10 may be pushed into an cable insulator 12 of the cable section 2 shown in FIG. 4. The cable insulator 12 radially spaces the inner cable contact 10 apart from an outer cable contact 14 of the cable section 2. In the embodiment shown in FIG. 1, a plurality of tabs 16 of the outer cable contact 14 of the cable section 2 are not definitively bent.

The cable section 2 has a region 18, shown in FIG. 1, which is bent through 90°. The bent region 18 has a rectangular cross-section for increasing a mechanical stability of the plug 1. On an end of the cable section 2 opposite the cable 8, a tubular receiving member 20 is disposed and configured for receiving the interface section 4.

The coaxial plug 1 is a modularly configurable plug. The tubular receiving member 20 is capable, for example, of receiving interface sections 4 with different lengths, whereby the plug 1 can be constructed in a modular manner. Furthermore, it may be possible to insert interface sections 4, which are shaped differently or which are configured for other product ranges, into the tubular receiving member 20. The various interface sections 4 can thereby have one of a plurality of different lengths and/or one of a plurality of different shapes and these various lengths and shapes are interchangeably connected to the cable section 2. The interface section 4 is adapted to produce a mechanical and electrical connection with a socket. For the sake of simplicity and by way of example, only a modular variant of the plug 1 is shown in FIGS. 1 and 2.

The interface section 4 can be pushed into the receiving member 20 in a non-positive-locking manner, and an inner interface contact 22 of the interface section 4 shown in FIG. 1 is connected in an electrically conductive manner to the inner cable contact 10 of the cable section 2. In an embodiment, an end of the inner interface contact 22 of the interface section 4 is clamped between a pair of metal tongues 23 of the inner cable contact 10 disposed at an end of the inner cable contact 10 to form an electrically conductive connection between the inner interface contact 22 of the interface section 4 and the inner cable contact 10 of the cable section 2. In an embodiment, an end of the inner interface contact 22 can be received at an angle of 90° by the metal tongues 23.

In another embodiment, the cable section 2 and the interface section 4 can be welded or soldered together. In such an embodiment, the cable section 2 may have an opening receiving a laser welding nozzle. The two inner contacts 10, 22 may have, at the end, faces with applied tin solder which, by acting on the coaxial plug 1 with heat, can be soldered to each other.

As shown in FIGS. 1 and 2, the inner interface contact 22 of the interface section 4 is spaced apart from an outer interface contact 26 of the interface section 4 by an interface insulator 24 of the interface section 4, and is connected in a positionally fixed manner to the outer interface contact 26 indirectly via the interface insulator 24 to the outer interface contact 26.

The outer cable contact 14 forms an outer housing component of the cable section 2 and the outer interface contact 26 forms an outer housing component of the interface section 4. When the interface section 4 is plugged in the receiving member 20 of the cable section 2, an electrically conductive connection is produced between the two outer contacts 14, 26. In an embodiment, the outer contacts 14, 26 are welded or soldered to each other.

The coaxial plug 1 with the interface section 4 disposed in the receiving member 20 is shown in FIG. 2. The interface section 4 may be connected to the cable section 2 in a positive-locking manner or a non-positive-locking manner. The inner cable contact 10 of the cable section 2, which is electrically connected to the cable 8, is inserted into the cable insulator 12, and the tabs 16 of the cable section 2 are bent over to mechanically fix the cable 8 as shown in FIG. 2. The bent-over tabs 16 further mechanically reduce the loading of the inner cable contact 10.

A first portion of a method 30 for producing the coaxial plug 1, the first portion producing the interface section 4, is shown in FIGS. 3A-3E. The arrows indicate the method sequence for producing the interface section 4 as a first portion of the method 30.

The inner interface contact 22, interface insulator 24, and outer interface contact 26 of the interface section 4 are each provided as an arrangement in a row of a large number of components 22, 24, 26, arranged on a carrier belt, a reel, or a roll. The remaining portions 28 of the carrier belts or carrier bands for each of the inner interface contact 22, interface insulator 24, and outer interface contact 26 are shown in the corresponding steps.

Figures 3A, 3B, 3C, 3D, 3E:
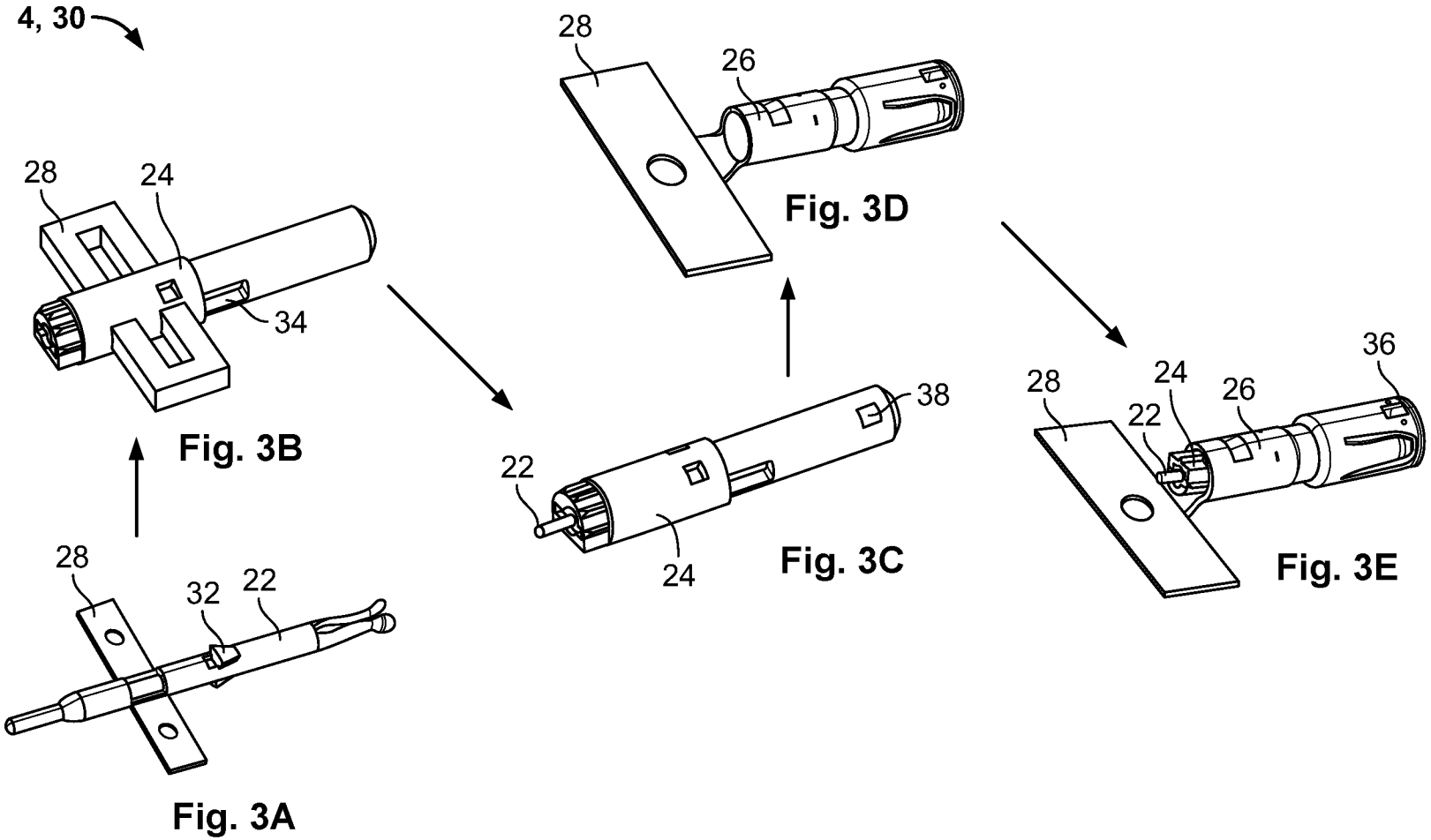
FIG. 3A is a perspective view of an inner interface contact.
FIG. 3B is a perspective view of an interface insulator.
FIG. 3C is a perspective view of the inner interface contact inserted in the interface insulator.
FIG. 3D is a perspective view of an outer interface contact.
FIG. 3E is a perspective view of the interface insulator inserted in the outer interface contact.

In a first step shown in FIG. 3A, an inner interface contact 22 is provided. After removal of the remaining portions 28 of the carrier band for the inner interface contact 22, the inner interface contact 22 can be pushed into an inner opening of the interface insulator 24, shown in FIG. 3B. A plurality of catch projections 32 of the inner interface contact 22 engage in a plurality of recesses 34 of the interface insulator 24, and fix the inner interface contact 22 in the interface insulator 24 in a positionally-fixed manner.

After removal of the remaining portions 28 of the carrier band of the interface insulator 24, as shown in FIG. 3C, the interface insulator 24 can be pushed with the inserted inner interface contact 22 into the outer interface contact 26 of the interface section 4 shown in FIG. 3D. As shown in FIG. 3D, the outer interface contact 26 is bent in a tubular manner. A plurality of catch tongues 36 of the outer interface contact 26 engage and lock in a positive-locking manner in a plurality of recesses 38 in the interface insulator 24. In another embodiment, this connection can also be produced in a concluding step by a subsequent local punching of the outer interface contact 26. The completed interface section 4 with the interface insulator 24 having the inserted inner interface contact 22 pushed into the outer interface contact 26 is shown in FIG. 3E and, subsequently, the remaining portions 28 of the carrier band of the outer interface contact 26 are removed.

A second portion of the method 30 for producing the coaxial plug 1 is shown in FIGS. 4A-4G. The second portion of the method 30 involves the production of the cable section 2, shown in FIGS. 4A-4D, and the connection of the cable section 2 to the interface section 4, shown in FIGS. 4E-4G, in order to form the coaxial plug 1. The arrows indicate the sequence of the method 30. A remaining portion 28 of the carrier band of the cable insulator 12 and the outer cable contact 14 are shown schematically.

Figures 4A, 4B, 4C, 4D, 4E, 4F, 4G:
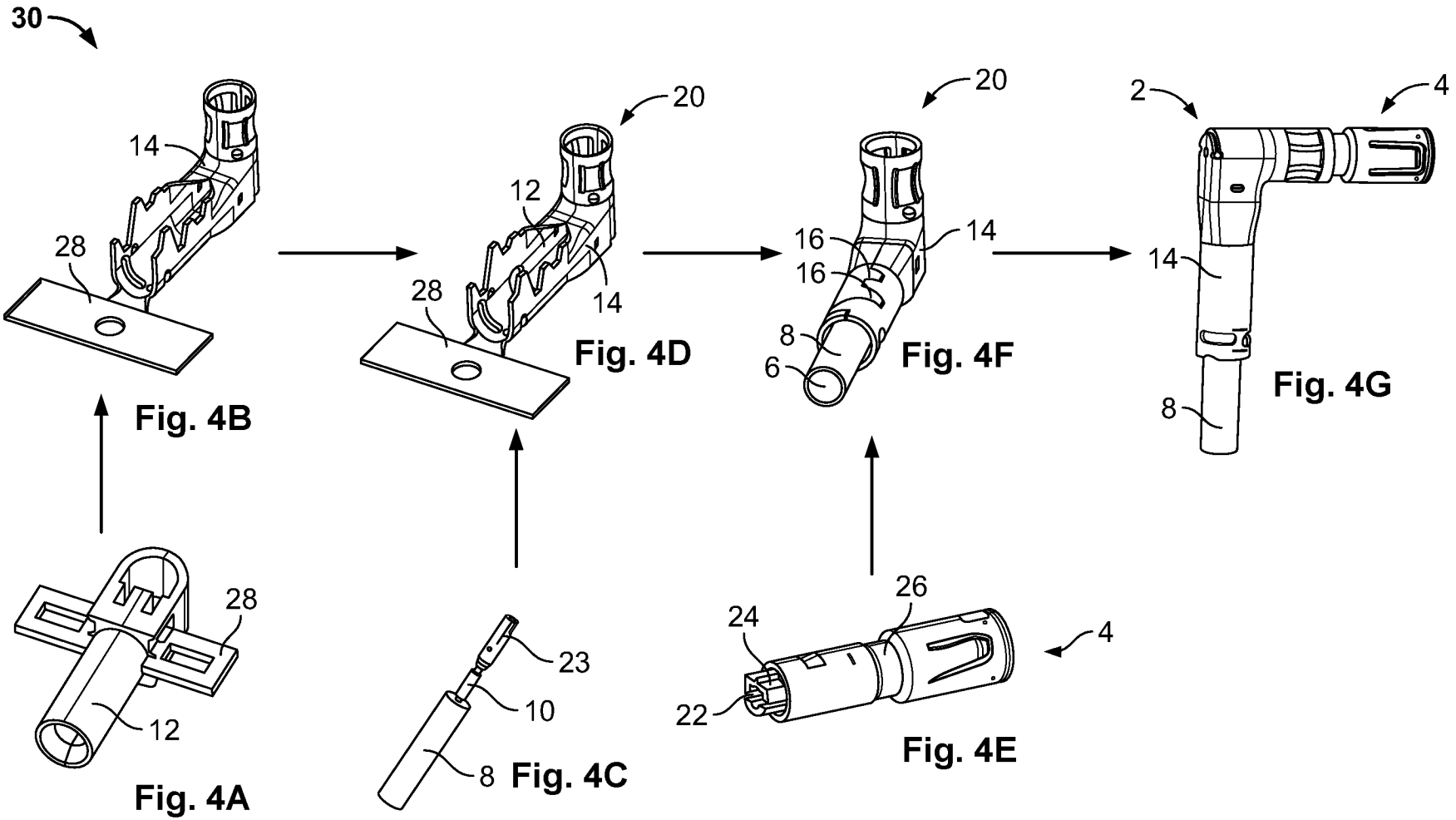
FIG. 4A is a perspective view of a cable insulator.
FIG. 4B is a perspective view of an outer cable contact.
FIG. 4C is a perspective view of a cable with an inner cable contact.
FIG. 4D is a perspective view of the cable insulator inserted in the outer cable contact.
FIG. 4E is a perspective view of an interface section.
FIG. 4F is a perspective view of a cable section.
FIG. 4G is a perspective view of the coaxial plug with the interface section inserted into the cable section.

In one step shown in FIG. 4B, a pre-shaped outer cable contact 14 of the cable section 2 is provided. As a result of the low structural height and width, the pre-shaped outer cable contact 14 can be provided and further processed on a carrier band. The cable insulator 12 of the cable section 2, as shown in FIG. 4A, is also provided as a portion of a large number of insulators 12 which are connected to each other on a roll, and the remaining portions 28 of the carrier band are removed from the cable insulator 12. Subsequently, the cable insulator 12 is positioned in the outer cable contact 14, as shown in FIG. 4D. As a result of the outer shape of the cable insulator 12 corresponding to the outer cable contact 14, the cable insulator 12 is arranged in the outer cable contact 14 in a torsion-resistant manner.

The inner cable contact 10 shown in FIG. 4C is connected to the strand 6 of the cable 8 mechanically and electrically. In an embodiment, the inner cable contact 10 is crimped to the strand 6. The inner cable contact 10, which is connected to the cable 8, is subsequently arranged in the cable insulator 12 which is positioned in the outer cable contact 14. A subsequent bending-over of the pre-bent tabs 16 of the outer cable contact 14, as shown in FIG. 4F, mechanically locks the cable sheath 8 to the outer cable contact 14 to form the cable section 2. The inner conductor 10 is retained at the end position thereof by the bent-over tabs 16 in a positionally fixed, torsion-resistant manner. The cable section 2 is adapted to a diameter of the cable 8 and a diameter of the inner cable contact 10.

The cable section 2 produced in such a manner can subsequently be connected to the interface section 4, shown in FIG. 4E, in order to form the coaxial plug 1, shown in FIG. 4G. The interface section 4 produced in the first portion of the method 30 is pushed into the receiving member 20 of the cable section 2. The outer cable contact 14 of the cable section 2 and the outer interface contact 26 of the interface section 4 are consequently connected to each other in a frictionally engaging manner. In a plugged-together state, the inner interface contact 22 of the interface section 4 projects into the metal tongues 23 of the inner cable contact 10 of the cable section 2. The metal tongues 23 apply a resilient force to the rod-like inner interface contact 22, and consequently produce an electrically conductive connection between the inner contacts 10, 22. In an embodiment, in an additional step, the outer contacts 14, 26 can be welded, soldered or subsequently compressed onto each other.

In various embodiments, the cable section 2 and the interface section 4 can be produced one after the other or in parallel with each other. As a result of the smaller dimensions of the individual pieces, the cable section 2 and the interface section 4 may be processed in automated processes using conventional applicators. The method for producing the modular plug 1 can thereby be implemented in previous production devices without extensive modifications.

The plug 1 can be used in a flexible and versatile manner because a definitive selection of the interface section 4 can be made, for example, only shortly before the process end. A plug 1 which can be produced in such a modular manner can be adapted rapidly and in a flexible manner to different application fields. Differently shaped interface sections 4 or interface sections 4 of different lengths can also be combined with different cable sections 2, whereby the versatility of the plug 1 can be further increased.

What is claimed is:

1. A method for producing a modularly configurable plug, comprising:

inserting a cable insulator in a pre-shaped outer cable contact;

positioning an inner cable contact of a cable in the cable insulator, the inner cable contact is separate from the pre-shaped outer cable contact, the inner cable contact is insulated from the pre-shaped outer cable contact by the cable insulator;

bending the pre-shaped outer cable contact to form a cable section, the cable section is adapted to a diameter of the cable and a diameter of the inner cable contact;

positioning an inner interface contact in an interface insulator;

inserting the interface insulator in an outer interface contact to form an interface section; and connecting the interface section to the cable section, the interface section having one of a plurality of different lengths or one of a plurality of different shapes interchangeably connected to the cable section.

2. The method of claim 1, wherein at least one of the inner cable contact, the cable insulator, the outer cable contact, the inner interface contact, the interface insulator, and the outer interface contact are provided arranged on a carrier belt or a roll.

3. The method of claim 1, wherein the inner cable contact is connected to an electrically conductive strand of the cable.

4. The method of claim 1, wherein the bending step mechanically connects the pre-shaped outer cable contact to the cable.

5. The method of claim 1, wherein the cable insulator is held in a torsion-resistant manner in the pre-shaped outer cable contact.

6. The method of claim 1, wherein the interface insulator is connected to the outer interface contact and positionally fixed with respect to the outer interface contact.

7. The method of claim 1, wherein the inner interface contact is positioned in a fixed manner in the interface insulator.

8. The method of claim 1, wherein, during the connecting step, the outer interface contact is electrically connected to the outer cable contact.

9. The method of claim 1, wherein, during the connecting step, the inner interface contact is electrically connected to the inner cable contact.

10. The method of claim 1, wherein the cable insulator is inserted in the pre-shaped outer cable contact before the inner cable contact is positioned in the cable insulator.

11. The method of claim 1, wherein the outer cable contact has a plurality of tabs bent during the bending step, the tabs abutting the cable and mechanically locking to the cable.

12. The method of claim 1, wherein the inner interface contact is insulated from the outer interface contact by the interface insulator.

13. A coaxial plug, comprising:

a cable section having an outer cable contact, a cable insulator disposed in the outer cable contact, and an inner cable contact spaced apart from the outer cable contact by the cable insulator, the inner cable contact is electrically connected to a cable and the outer cable contact is mechanically connected to the cable; and an interface section mechanically and electrically connected to the cable section, the interface section has one of a plurality of different lengths or one of a plurality of different shapes interchangeably connected to the cable section and is adapted to produce a mechanical and electrical connection with a socket, the interface section has an interface insulator, an inner interface contact positioned in the interface insulator, and an outer interface contact positioned around the interface insulator, the inner interface contact has a plurality of catch projections engaging a plurality of recesses of the interface insulator.

14. The coaxial plug of claim 13, wherein the interface section is inserted into a receiving member of the cable section.

15. The coaxial plug of claim 13, wherein the cable section has a shape that is bent through a 90° angle.

16. The coaxial plug of claim 13, wherein the inner cable contact has a pair of metal tongues receiving an end of an inner interface contact of the interface section in a non-positive-locking, positive-locking or materially engaging manner.

17. The coaxial plug of claim 16, wherein the end of the inner interface contact is received at a 90° angle by the metal tongues of the inner cable contact.

18. The coaxial plug of claim 13, wherein the outer interface contact has a plurality of catch tongues engaging a plurality of recesses of the interface insulator.

19. A coaxial plug, comprising:

a cable section having an outer cable contact, a cable insulator disposed in the outer cable contact, and an inner cable contact spaced apart from the outer cable contact by the cable insulator, the inner cable contact is electrically connected to a cable and the outer cable contact is mechanically connected to the cable; and an interface section mechanically and electrically connected to the cable section, the interface section has one of a plurality of different lengths or one of a plurality of different shapes interchangeably connected to the cable section and is adapted to produce a mechanical and electrical connection with a socket, the interface section has an interface insulator, an inner interface contact positioned in the interface insulator, and an outer interface contact positioned around the interface insulator, the outer interface contact has a plurality of catch tongues engaging a plurality of recesses of the interface insulator.

* * * * *